US010312588B2

(12) United States Patent
Zhang et al.

(10) Patent No.: US 10,312,588 B2
(45) Date of Patent: Jun. 4, 2019

(54) PHASED-ARRAY ANTENNA AND MULTI-FACE ARRAY ANTENNA DEVICE

(71) Applicant: BOE TECHNOLOGY GROUP CO., LTD., Beijing (CN)

(72) Inventors: Yuxin Zhang, Beijing (CN); Xinyin Wu, Beijing (CN); Yong Qiao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 18 days.

(21) Appl. No.: 15/715,522

(22) Filed: Sep. 26, 2017

(65) Prior Publication Data

US 2018/0212325 A1 Jul. 26, 2018

(30) Foreign Application Priority Data

Jan. 25, 2017 (CN) ..... 2017 2 0098037 U

(51) Int. Cl.

| | |
|---|---|
| ***H01Q 15/02*** | (2006.01) |
| ***H01Q 3/26*** | (2006.01) |
| ***H01Q 3/44*** | (2006.01) |
| ***H01Q 21/20*** | (2006.01) |
| *H01Q 21/06* | (2006.01) |

(52) U.S. Cl.

CPC ..... *H01Q 3/2676* (2013.01); *H01Q 3/44* (2013.01); *H01Q 21/205* (2013.01); *H01Q 21/064* (2013.01); *H01Q 21/065* (2013.01)

(58) Field of Classification Search

CPC ..... H01Q 3/2676; H01Q 3/44; H01Q 21/205

See application file for complete search history.

(56) References Cited

U.S. PATENT DOCUMENTS

| | | | | |
|---|---|---|---|---|
| 6,034,634 A * | 3/2000 | Karlsson | H01Q 3/08 | 342/359 |
| 2008/0122699 A1* | 5/2008 | Yeh | H01Q 9/0407 | 343/700 MS |
| 2009/0153422 A1* | 6/2009 | Chiang | H01Q 1/2266 | 343/749 |
| 2010/0177011 A1* | 7/2010 | Sego | H01Q 1/28 | 343/893 |

* cited by examiner

*Primary Examiner* — Dieu Hien T Duong
(74) *Attorney, Agent, or Firm* — Brooks Kushman P.C.

(57) ABSTRACT

A phased-array antenna and a multi-face array antenna device are provided. The phased-array antenna includes a liquid crystal cell. The liquid crystal cell includes an upper substrate, a lower substrate and a liquid crystal layer. The upper substrate includes a first base substrate, a plurality of first bias electrodes arranged at a first surface of the first base substrate, and a plurality of radiating elements arranged at a second surface of the first base substrate. The lower substrate includes a second base substrate, a plurality of second bias electrodes arranged at a second surface of the second base substrate, and a ground electrode arranged at a first surface of the second base substrate. The first base substrate and the second base substrate of the liquid crystal cell are arc-shaped substrates so that the radiating elements are not coplanar. In addition, the radiating elements are arranged at a convex surface.

18 Claims, 3 Drawing Sheets

PHASED-ARRAY ANTENNA AND MULTI-FACE ARRAY ANTENNA DEVICE

CROSS-REFERENCE TO RELATED APPLICATION

This application claims priority to Chinese Patent Application No. 201720098037.1 filed on Jan. 25, 2017, which is incorporated herein by reference in its entirety.

TECHNICAL FIELD

The present disclosure relates to a wireless communication device, in a particular to a phased-array antenna and a multi-face array antenna device.

BACKGROUND

Most of the wireless communication devices are equipped with antennae, so as to transmit or receive an electromagnetic signal. In order to enhance a capability of transmitting or receiving the electromagnetic signal, usually a plurality of antennae is arranged to form an array antenna.

Along with the development of the array antenna, a phased-array antenna has emerged. The phased-array antenna mainly includes a phase shifter and a plurality of radiating elements arranged in an array form. The phase shifter is configured to shift a phase of the received electromagnetic signal, and each radiating element is configured to radiate outward the electromagnetic signal acquired after the phase-shifting. There is a certain phase difference between the signals radiated by the radiating elements. Through controlling a size of the phase difference between the signals radiated by the radiating elements, it is able to synthesize main beams in different orientations for scanning.

For a conventional phased-array antenna, its phase shifter includes a liquid crystal cell, which includes two planar substrates arranged opposite to each other form a cell. The plurality of radiating elements is arranged at an exterior wall of one of the planar substrates. The electromagnetic signal is introduced into the liquid crystal cell, and liquid crystals are deflected, so as to shift the phase of the electromagnetic signal. Then, the electromagnetic signal acquired after the phase-shifting is radiated outward by the plurality of radiating elements. During the operation of the antenna, in the case that a specific position is scanned by the main beam, its gain may be reduced dramatically. In order to prevent the reduction in the gain, a scanning range of the phased-array antenna is usually within −45° to +45° relative to an array plane normal. The application and development of the phased-array antenna are extremely limited by such a narrow scanning range.

SUMMARY

An object of the present disclosure is to provide a phased-array antenna and a multi-face array antenna device, so as to increase a scanning angle of the phased-array antenna.

In one aspect, the present disclosure provides in some embodiments a phased-array antenna, including a liquid crystal cell. The liquid crystal cell includes an upper substrate, a lower substrate arranged opposite to the upper substrate to form a cell, and a liquid crystal layer arranged between the upper substrate and the lower substrate. The upper substrate includes a first base substrate, a plurality of first bias electrodes arranged at a first surface of the first base substrate, and a plurality of radiating elements arranged at a second surface of the first base substrate opposite to the first surface of the first base substrate. The lower substrate includes a second base substrate, a plurality of second bias electrodes arranged at a second surface of the second base substrate, and a ground electrode arranged at a first surface of the second base substrate opposite to the second surface of the second base substrate. The first base substrate and the second base substrate are both arc-shaped substrates. The first surface of the first base substrate and the first surface of the second base substrate are concave surfaces, the second surface of the first base substrate and the second surface of the second base substrate are convex surfaces, and the first surface of the first base substrate is arranged opposite to the second surface of the second base substrate.

In a possible embodiment of the present disclosure, the plurality of first bias electrodes is arranged in at least one column on the first base substrate, and the first bias electrodes in each column comprise a plurality of first electrodes spaced apart from each other in a first direction. The plurality of second bias electrodes is arranged in at least one column on the second base substrate, and the second bias electrodes in each column comprise a plurality of second electrodes spaced apart from each other in the first direction. In the case that the first bias electrodes are arranged in a plurality of columns, the columns of first bias electrodes are spaced apart from each other in a second direction perpendicular to the first direction. The first bias electrodes in each column correspond to the second bias electrodes in a respective one column, and a projection of the first bias electrodes in each column onto a tangent plane of the second surface of the second base substrate and a projection of the second bias electrodes in the respective one column corresponding to the first bias electrodes onto the tangent plane are located in an identical line. Among the first bias electrodes in each column and the second bias electrodes in the respective one column corresponding to the first bias electrodes, the first electrodes and the second electrodes are arranged alternately in the first direction, a distance between two adjacent first electrodes is smaller than a length of one of the second electrodes in the first direction, and a distance between two adjacent second electrodes is smaller than a length of one of the first electrodes in the first direction.

In a possible embodiment of the present disclosure, a first conductive layer is arranged on the first base substrate, and the plurality of first electrodes is arranged on the first conductive layer. A second conductive layer is arranged on the second base substrate, and the plurality of second electrodes is arranged on the second conductive layer.

In a possible embodiment of the present disclosure, the first conductive layer is an indium tin oxide layer.

In a possible embodiment of the present disclosure, the second conductive layer is an indium tin oxide layer or a metal layer.

In a possible embodiment of the present disclosure, one of the radiating elements is arranged at a position corresponding to a gap between any two adjacent first electrodes in the first direction.

In a possible embodiment of the present disclosure, each radiating element is a patch antenna or a slot antenna.

In a possible embodiment of the present disclosure, the patch antenna is of a circular, elliptical or polygonal shape.

In a possible embodiment of the present disclosure, the first bias electrodes and the second bias electrodes are each a metal electrode.

In a possible embodiment of the present disclosure, the first base substrate and the second base substrate are each a glass substrate, a silicon substrate or a plastic substrate.

In another aspect, the present disclosure provides in some embodiments a multi-face array antenna device, including a platform and at least two phased-array antennae arranged on the platform, wherein at least one of the phased-array antennae is the above-mentioned phased-array antenna.

In a possible embodiment of the present disclosure, the platform is provided with at least two mounting surfaces, at least two of the mounting surfaces intersect each other, and at least one of the phased-array antennae is arranged at each mounting surface.

In a possible embodiment of the present disclosure, the platform is of a prismatic or cylindrical shape.

In a possible embodiment of the present disclosure, the platform is of a spherical or hemispherical shape.

In a possible embodiment of the present disclosure, the multi-face array antenna device further includes a rotatable table onto which the platform is fixed.

In a possible embodiment of the present disclosure, the rotatable table includes a seat and a driving mechanism, wherein the driving mechanism is configured to drive the seat to rotate, to enable the platform fixed onto the seat to rotate.

BRIEF DESCRIPTION OF THE DRAWINGS

In order to illustrate the technical solutions of the present disclosure in a clearer manner, the drawings desired for the present disclosure will be described hereinafter briefly. Obviously, the following drawings merely relate to some embodiments of the present disclosure, and based on these drawings, a person skilled in the art may obtain the other drawings without any creative effort.

DETAILED DESCRIPTION

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

Figure 1:
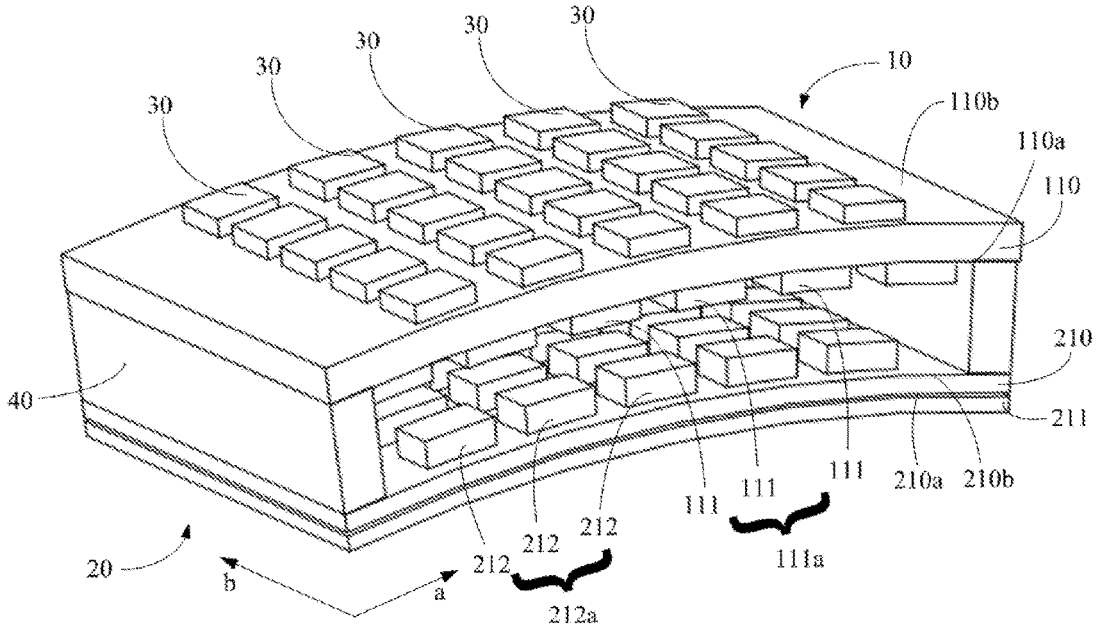
FIG. 1 is a schematic view showing a phased-array antenna according to one embodiment of the present disclosure.

The present disclosure provides in some embodiments a phased-array antenna which, as show in FIG. 1, includes a liquid crystal cell. The liquid crystal cell includes an upper substrate 10, a lower substrate 20 arranged opposite to the upper substrate 10 to form a cell, and a liquid crystal layer (not shown) arranged between the upper substrate and the lower substrate.

The upper substrate 10 includes a first base substrate 110, a first bias electrode 111*a* arranged at a first surface 110*a* of the first base substrate 110, and a plurality of radiating elements 30 arranged at a second surface 110*b* of the first base substrate 110 opposite to the first surface 110*a* of the first base substrate 110. The lower substrate 20 includes a second base substrate 210, a second bias electrode 212*a* arranged at a second surface 210*b* of the second base substrate 210, and a ground electrode 211 arranged at a first surface 210*a* of the second base substrate 210 opposite to the second surface 210*b* of the second base substrate 210.

The first base substrate 110 and the second base substrate 210 are both arc-shaped substrates. The first surface 110*a* of the first base substrate 110 and the first surface 210*a* of the second base substrate 210 are concave surfaces, the second surface 110*b* of the first base substrate 110 and the second surface 210*b* of the second base substrate 210 are convex surfaces, and the first surface 110*a* of the first base substrate 110 is arranged opposite to the second surface 210*a* of the second base substrate 210.

According to the phased-array antenna in the embodiments of the present disclosure, the first base substrate and the second base substrate of the liquid crystal cell are each of an arc shape, so the plurality of radiating elements is not coplanar. An electromagnetic wave is radiated by each radiating element within a fixed range, and in the case that the plurality of radiating elements is arranged on a convex surface, it is able to increase a total angular range of the electromagnetic waves from the radiating elements. In the case that a position at a large angle is scanned by a main beam, it is able to reduce an extent of the gain to be decreased. As a result, it is able to increase a scanning range of the phased-array antenna, thereby to enable the phased-array antenna to perform the scanning operation even at a low elevation angle.

During the implementation, edges of the first base substrate 110 and the second base substrate 210 may be connected to each other through a sealant 40. The sealant 40 may be an ultraviolet (UV)-curable sealant or a thermosetting sealant.

As shown in FIG. 1, a plurality of first bias electrodes 111*a* is arranged in a plurality of columns on the first base substrate 110, and the first bias electrodes 111*a* in each column include a plurality of first electrodes 111 spaced apart from each other in a first direction (indicated by the arrow a in FIG. 1). A plurality of second bias electrodes 212*a* is arranged in a plurality of columns on the second base substrate 210, and the second bias electrodes 212*a* in each column include a plurality of second electrodes 212 spaced apart from each other in the first direction. In the case that the first bias electrodes 111*a* are arranged in a plurality of columns, the columns of first bias electrodes 111*a* are spaced apart from each other in a second direction (indicated by the arrow b in FIG. 1) perpendicular to the first direction. The first bias electrodes 111*a* in each column correspond to the second bias electrodes 212*a* in a respective one column, and a projection of the first bias electrodes 111*a* in each column onto a tangent plane of the second surface 210*b* of the second base substrate 210 and a projection of the second bias electrodes 212*a* in the respective one column corresponding to the first bias electrodes 111*a* onto the tangent plane are located in an identical line. Among the first bias electrodes 111*a* in each column and the second bias electrodes 212*a* in the respective one column corresponding to the first bias electrodes 111*a*, the first electrodes 111 and the second electrodes 212 are arranged alternately in the first direction, a distance between two adjacent first electrodes 111 is smaller than a length of one of the second electrode 121 in the first direction, and a distance between two adjacent second electrodes 212 is smaller than a length of one of the first electrodes 111 in the first direction.

In a possible embodiment of the present disclosure, merely one column of the first bias electrodes 111*a* and one column of the second bias electrodes 212*a* may be provided.

The plurality of first electrodes 111 and the plurality of second electrodes 212 are arranged in the first direction. Because the distance between the two adjacent first electrodes 111 is smaller than the length of the second electrode 212 in the first direction and the distance between the two adjacent second electrodes 212 is smaller than the length of the first electrode 111 in the first direction, apart from the outermost first electrode 111 or second electrode 212 in the first direction, a portion of each first electrode 111 may face two adjacent second electrodes 212, and a portion of each second electrode 212 may face two adjacent first electrodes 111. A capacitor may be formed at a region where the first electrode 111 is arranged directly opposite to the second electrode 212. In the case that the electromagnetic wave is transmitted in the liquid crystal cell, it may be transmitted in an order of the first electrode 111—the capacitor—the second electrode 212—the capacitor—the first electrode 111, i.e., in the first direction. At a region where the first electrode 111 is arranged directly opposite to the second electrode 212, the electromagnetic wave may be deflected due to liquid crystals, and thereby its phase may be shifted. The electromagnetic waves radiated outward through the gaps between every two first electrodes 111 may be transmitted through different numbers of capacitors, so the electromagnetic waves radiated outward through the gaps may be deflected for different times, and thereby there is a certain phase difference between the electromagnetic waves radiated outward through the adjacent gaps. In the case that merely one column of first bias electrodes 111*a* and one column of second bias electrodes 212*a* are provided, they may form a linear array. In the case that a plurality of columns of first bias electrodes 111*a* and a plurality of columns of second bias electrodes 212*a* are provided, they may form a planar array. As compared with the linear array, it is able for the planar array to provide a larger spatial scanning range.

During the implementation, the phased-array antenna may further include a control circuit (not shown), and the first electrodes 111 and the second electrodes 212 are electrically connected to the control circuit. To be specific, the first electrodes 111 and the second electrodes 212 may be electrically connected to the control circuit through metal leads. The control circuit may be configured to change a voltage difference between the first electrode 111 and the second electrode 212, so as to change a deflection degree of liquid crystal molecules in the liquid crystal layer, thereby to adjust a phase of the electromagnetic wave.

To be specific, the first bias electrodes 111*a* and the second bias electrodes 212*a* may each be a metal electrode, so as to facilitate the connection to a lead since the metal electrode is easy to be manufactured.

In a possible embodiment of the present disclosure, the first base substrate 110 and the second base substrate 210 may each be a glass substrate, a silicon substrate or a plastic substrate.

Figure 2:
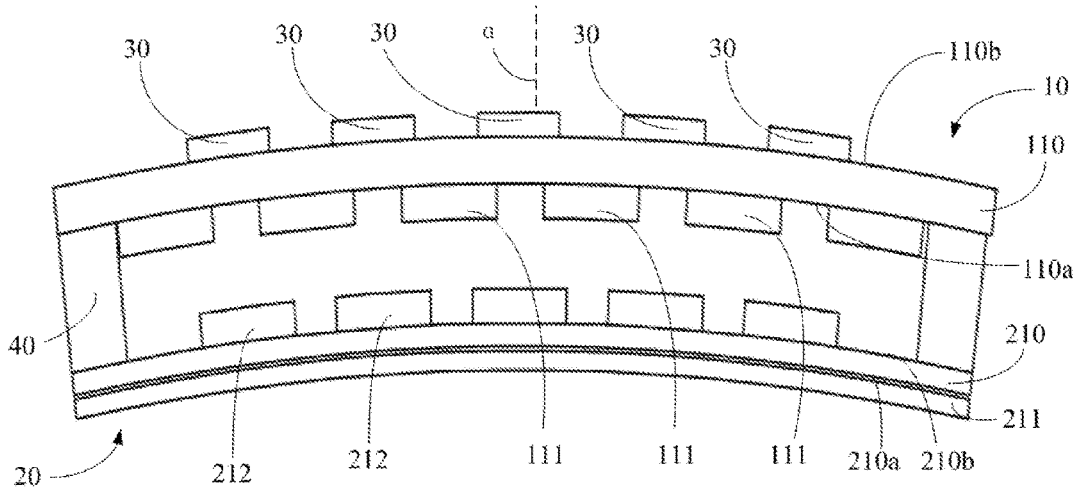
FIG. 2 is a sectional view of the phased-array antenna according to one embodiment of the present disclosure.

As shown in FIG. 2 which is a sectional view of the phased-array antenna, one of the radiating elements 30 is arranged at a position corresponding to a gap between any two adjacent first electrodes 111 in the first direction. In this way, it is able to couple the electromagnetic wave radiated through the gap between the two adjacent first electrodes 111 to the radiating element 30, and then enable the electromagnetic wave to be radiated outward through the radiating element 30.

In a possible embodiment of the present disclosure, the radiating element 30 may be a patch antenna or a slot antenna. Depending on different design requirements, different radiating elements 30 may be selected. In a possible embodiment of the present disclosure, the radiating element 30 may be the patch antenna.

Further, the patch antenna may be of a circular, elliptical or polygonal shape. The radiation of the electromagnetic wave may be affected by the shape of the patch antenna, so the patch antenna may be provided with various shapes so as to meet different design requirements.

During the implementation, the patch antenna may be made of metal.

It should be appreciated that, the so-called "elevation angle" mentioned in the embodiments of the present disclosure refers to a complementary angle of an angle between a scanning beam and a normal $\alpha$ at a center of the second surface 110*b* of the first base substrate 110 in FIG. 2. The larger the angle between the scanning beam and the normal $\alpha$, the smaller the elevation angle.

Figure 3:
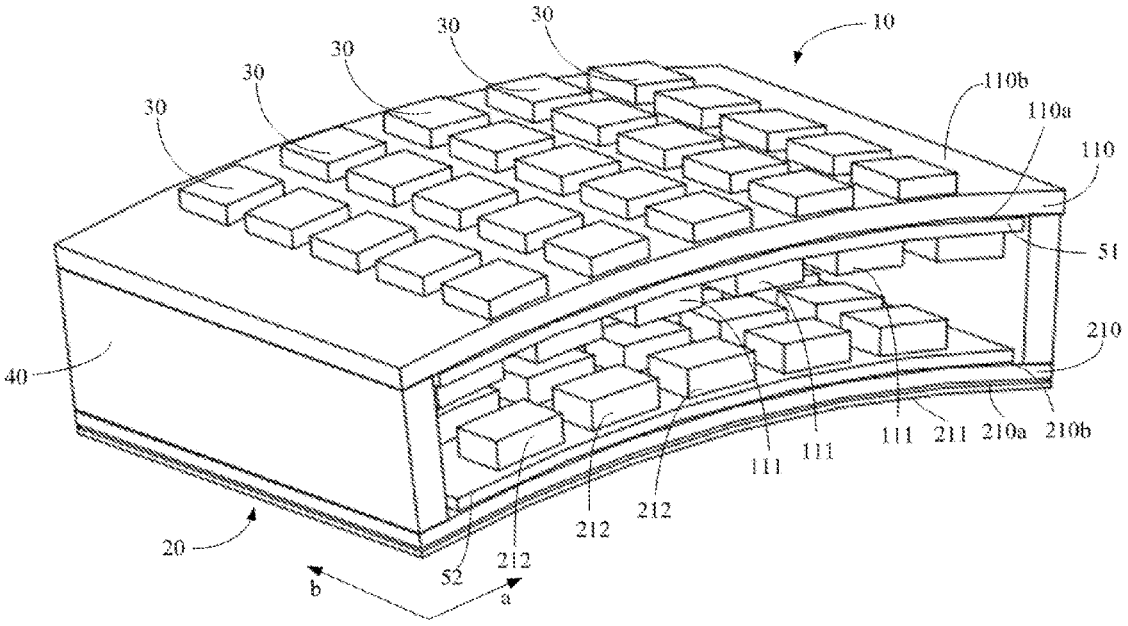
FIG. 3 is a schematic view showing another phased-array antenna according to one embodiment of the present disclosure.

As shown in FIG. 3 which is a schematic view showing another phased-array antenna, the phased-array antenna differs from the phased-array antenna in FIG. 1 merely in that a first conductive layer 51 is arranged on the first base substrate 110 and a second conductive layer 52 is arranged on the second base substrate 210. The plurality of first electrodes 111 is arranged on the first conductive layer 51, and the plurality of second electrodes 212 is arranged on the second conductive layer 52.

Through the arrangement of the first electrodes 111 on the first conductive layer 51 and the arrangement of the second electrodes 212 on the second conductive layer 52, an identical voltage difference be provided between two ends of each capacitor. In the case that a voltage is applied to the first conductive layer 51 and the second conductive layer 52, the liquid crystal molecules at the region where the first electrode 111 is arranged directly opposite to the second electrode 212 may have an identical deflection degree. At this time, in the case that the electromagnetic wave is transmitted in the first direction, an identical phase change may occur for the electromagnetic wave every time it is transmitted through the capacitor. In addition, through changing the voltage difference between the first conductive layer 51 and the second conductive layer 52, it is able to correspondingly change a phase shift amount generated each time. Further, after the arrangement of the first conductive layer 51 and the second conductive layer 52, the first conductive layer 51 and the second conductive layer 52 may be connected to the control circuit through leads, i.e., it is unnecessary to provide the lead between each first electrode 111 and the control circuit or between each second electrode 212 and the control circuit, so it is able to facilitate the wiring, simplify the manufacturing process and improve the production efficiency.

In a possible embodiment of the present disclosure, the first conductive layer 51 is an indium tin oxide layer or a metal layer. For example, the first conductive layer 51 may be the indium tin oxide layer, and at this time, because the electromagnetic wave entering the liquid crystal cell is usually a radio frequency signal which may be transmitted through the indium tin oxide layer at high transmissivity, it is able to reduce the absorption of the electromagnetic wave in the case that the indium tin oxide layer is adopted.

In a possible embodiment of the present disclosure, the second conductive layer 52 is an indium tin oxide layer or a metal layer. Because it is merely necessary for the liquid crystal cell to radiate the electromagnetic wave to a side adjacent to the patch antenna, the second conductive layer 52 may be the metal layer. Alternatively, the indium tin oxide layer may also be adopted. In actual use, the second conductive layer 52 may be made of such a material as to reduce the cost of the material as well as the manufacture cost.

Figure 4:
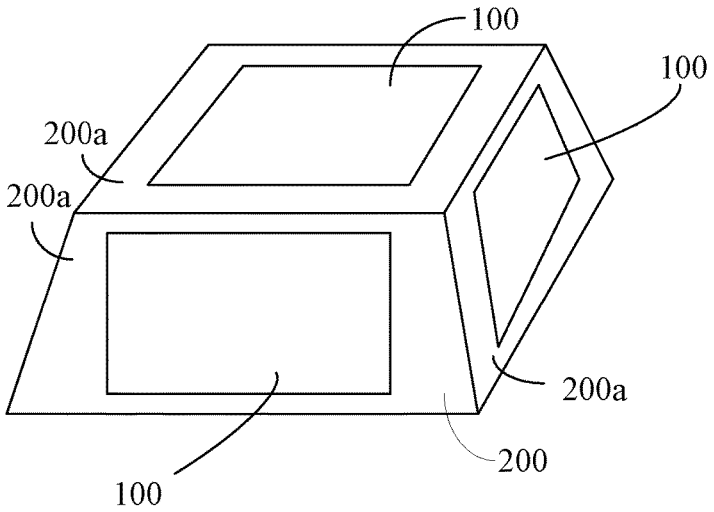
FIG. 4 is a schematic view showing a multi-face array antenna device according to one embodiment of the present disclosure.

As shown in FIG. 4 which is a schematic view showing a multi-face array antenna device, the multi-face array antenna device includes a platform 200 and at least two phased-array antennae 100 arranged on the platform, and at least one of the at least two phased-array antennae 100 is just the above-mentioned phased-array antenna.

According to the multi-face array antenna device in the embodiments of the present disclosure, the first base substrate and the second base substrate of the liquid crystal cell are each of an arc shape, so the plurality of radiating elements is not coplanar. An electromagnetic wave is radiated by each radiating element within a fixed range, and in the case that the plurality of radiating elements is arranged on a convex surface, it is able to increase a total angular range of the electromagnetic waves from the radiating elements. In the case that a position at a large angle is scanned by a main beam, it is able to reduce an extent of the gain to be decreased. As a result, it is able to increase a scanning range of the phased-array antenna.

As shown in FIG. 4, the platform 200 is of a prismatic shape and includes a top surface, a bottom surface and four side surfaces. The platform 200 may have five mounting surfaces 200*a* (i.e., the top surface and the four side surfaces), and at least two of these mounting surfaces 200*a* intersect each other. One phased-array antenna 100 may be arranged on each mounting surface 200*a*. Because the mounting surfaces 200*a* of the platform 200 intersect each other, it is able to facilitate the control of an orientation of the phased-array antenna 100, thereby to increase the scanning range of the multi-face array antenna device.

During the implementation, the platform 200 may be provided with at least two mounting surfaces 200*a*, so as to enable the phased-array antennae 100 to face different directions. Each phased-array antenna 100 may face a direction of the normal at the center of the second surface 110*b* of the first base substrate 110 of the phased-array antenna 100.

Figure 5:
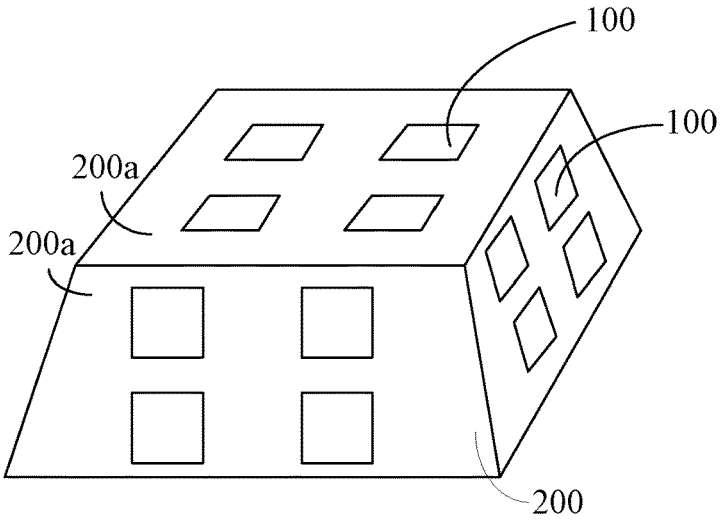
FIG. 5 is a schematic view showing another multi-face array antenna device according to one embodiment of the present disclosure.

As shown in FIG. 5 which is a schematic view showing another multi-face array antenna device, the multi-face array antenna device differs from that in FIG. 4 merely in that a plurality of phased-array antennae 100 is arranged at each mounting surface 200*a*.

Figure 6:
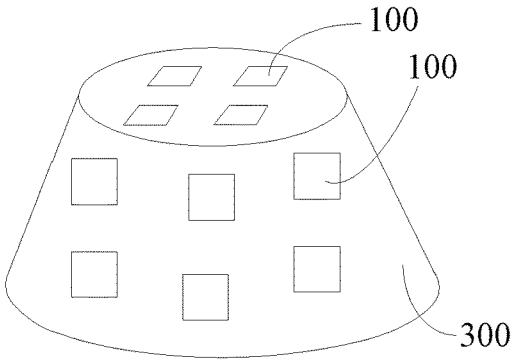
FIG. 6 is a schematic view showing yet another multi-face array antenna device according to one embodiment of the present disclosure.

As shown in FIG. 6 which is a schematic view showing yet another multi-face array antenna device, the multi-face array antenna device differs from that in FIGS. 4 and 5 merely in that the platform 300 is of a cylindrical shape, rather than the prismatic shape in FIGS. 4 and 5.

It should be appreciated that, although the platform 200 in FIG. 5 is of a prismatic shape and the platform 200 in FIG. 6 is of a cylindrical shape, in some other embodiments of the present disclosure, the platform may also be of any other geometrical shapes, i.e., the shape of the platform may be set in accordance with the practical need so as to meet different design requirements.

In a possible embodiment of the present disclosure, the platform may also be of a spherical shape, and at this time, the platform may have a spherical outer wall. In the case that the phased-array antenna is arranged on the spherical outer wall, it is able to further increase the scanning range. In a possible embodiment of the present disclosure, the platform may also be of a hemispherical shape.

Figure 7:
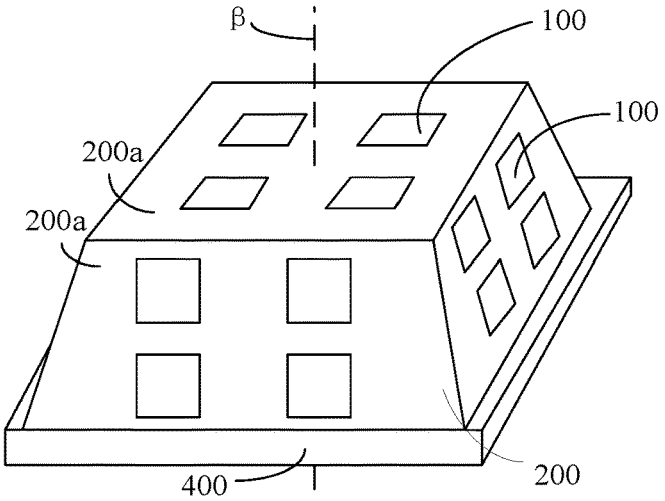
FIG. 7 is a schematic view showing still yet another multi-face array antenna device according to one embodiment of the present disclosure.

As shown in FIG. 7 which is a schematic view showing yet another multi-face array antenna device, the multi-face array antenna device may further include a rotatable table 400 onto which the platform 200 is fixed. The rotatable table 400 may rotate about a rotary shaft (3, and through the rotation of the rotatable table 400, it is able to change the orientation of the antenna, thereby to further increase the scanning range of the phased-array antenna.

During the implementation, the rotatable table 400 may include a seat, and a driving mechanism configured to drive the seat to rotate about the rotary shaft (3, so as to rotate the platform 200 fixed onto the seat.

The above are merely the preferred embodiments of the present disclosure, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A phased-array antenna, comprising a liquid crystal cell, wherein the liquid crystal cell comprises an upper substrate, a lower substrate arranged opposite to the upper substrate to form a cell, and a liquid crystal layer arranged between the upper substrate and the lower substrate;

the upper substrate comprises a first base substrate, a plurality of first bias electrodes arranged at a first surface of the first base substrate, and a plurality of radiating elements arranged at a second surface of the first base substrate opposite to the first surface of the first base substrate;

the lower substrate comprises a second base substrate, a plurality of second bias electrodes arranged at a second surface of the second base substrate, and a ground electrode arranged at a first surface of the second base substrate opposite to the second surface of the second base substrate;

the first base substrate and the second base substrate are both arc-shaped substrates;

the first surface of the first base substrate and the first surface of the second base substrate are concave surfaces, the second surface of the first base substrate and the second surface of the second base substrate are convex surfaces, and the first surface of the first base substrate is arranged opposite to the second surface of the second base substrate;

the plurality of first bias electrodes is arranged in at least one column on the first base substrate, and the first bias electrodes in each column comprise a plurality of first electrodes spaced apart from each other in a first direction;

the plurality of second bias electrodes is arranged in at least one column on the second base substrate, and the second bias electrodes in each column comprise a plurality of second electrodes spaced apart from each other in the first direction;

in the case that the first bias electrodes are arranged in a plurality of columns, the columns of first bias electrodes are spaced apart from each other in a second direction perpendicular to the first direction;

the first bias electrodes in each column correspond to the second bias electrodes in a respective one column, and a projection of the first bias electrodes in each column onto a tangent plane of the second surface of the second base substrate and a projection of the second bias electrodes in the respective one column corresponding to the first bias electrodes onto the tangent plane are located in an identical line; and among the first bias electrodes in each column and the second bias electrodes in the respective one column corresponding to the first bias electrodes, the first electrodes and the second electrodes are arranged alternately in the first direction, a distance between two adjacent first electrodes is smaller than a length of one of the second electrodes in the first direction, and a distance between two adjacent second electrodes is smaller than a length of one of the first electrodes in the first direction.

2. The phased-array antenna according to claim 1, wherein a first conductive layer is arranged on the first base substrate, and the plurality of first electrodes is arranged on the first conductive layer; and a second conductive layer is arranged on the second base substrate, and the plurality of second electrodes is arranged on the second conductive layer.

3. The phased-array antenna according to claim 2, wherein the first conductive layer is an indium tin oxide layer.

4. The phased-array antenna according to claim 2, wherein the second conductive layer is an indium tin oxide layer or a metal layer.

5. The phased-array antenna according to claim 1, wherein one of the radiating elements is arranged at a position corresponding to a gap between any two adjacent first electrodes in the first direction.

6. The phased-array antenna according to claim 1, wherein each of the radiating elements is a patch antenna or a slot antenna.

7. The phased-array antenna according to claim 6, wherein the patch antenna is of a circular, elliptical or polygonal shape.

8. The phased-array antenna according to claim 1, wherein each of the first bias electrodes and the second bias electrodes is a metal electrode.

9. The phased-array antenna according to claim 1, wherein each of the first base substrate and the second base substrate is a glass substrate, a silicon substrate or a plastic substrate.

10. A multi-face array antenna device, comprising a platform and at least two phased-array antennae arranged on the platform, wherein at least one of the phased-array antennae is the phased-array antenna according to claim 1.

11. The multi-face array antenna device according to claim 10, wherein the platform is provided with at least two mounting surfaces, at least two of the mounting surfaces intersect each other, and at least one of the phased-array antennae is arranged at each of the mounting surfaces.

12. The multi-face array antenna device according to claim 11, wherein the platform is of a prismatic or cylindrical shape.

13. The multi-face array antenna device according to claim 10, wherein the platform is of a spherical or hemispherical shape.

14. The multi-face array antenna device according to claim 10, further comprising a rotatable table, wherein the platform is fixed onto the rotatable table.

15. The multi-face array antenna device according to claim 14, wherein the rotatable table comprises a seat and a driving mechanism, wherein the driving mechanism is configured to drive the seat to rotate, to enable the platform fixed onto the seat to rotate.

16. The multi-face array antenna device according to claim 10, wherein a first conductive layer is arranged on the first base substrate, and the plurality of first electrodes is arranged on the first conductive layer; and a second conductive layer is arranged on the second base substrate, and the plurality of second electrodes is arranged on the second conductive layer.

17. The multi-face array antenna device according to claim 16, wherein the first conductive layer is an indium tin oxide layer.

18. The multi-face array antenna device according to claim 16, wherein the second conductive layer is an indium tin oxide layer or a metal layer.

* * * * *